US006951499B1

(12) United States Patent
Gulmesoff

(10) Patent No.: US 6,951,499 B1
(45) Date of Patent: Oct. 4, 2005

(54) TOY SWORD WITH CONTACT INDICATOR

(76) Inventor: Andre Arturo Gulmesoff, 4565 Shasta Cir., Cypress, CA (US) 90630

( * ) Notice: Subject to any disclaimer, the term of this patent is extended or adjusted under 35 U.S.C. 154(b) by 0 days.

(21) Appl. No.: 10/839,530

(22) Filed: May 4, 2004

(51) Int. Cl.[7] ..... A63H 33/30; A63H 23/08; B43K 5/18; B43K 5/10

(52) U.S. Cl. ..... 446/473; 446/267; 446/475; 401/148; 401/178

(58) Field of Search ..... 446/473, 475, 446/193, 483, 267; 401/148, 178; 482/12, 482/83, 84

(56) References Cited

U.S. PATENT DOCUMENTS 4,208,701 A 6/1980 Schock
4,231,077 A * 10/1980 Joyce et al. ..... 362/577
4,678,450 A * 7/1987 Scolari et al. ..... 446/405
4,892,303 A * 1/1990 Lohre ..... 482/12
4,904,222 A 2/1990 Gastgeb et al.
5,145,446 A * 9/1992 Kuo ..... 446/405
5,245,099 A 9/1993 Mitariten
5,256,099 A * 10/1993 Rudell et al. ..... 446/473
5,279,513 A 1/1994 Connelly
5,321,591 A 6/1994 Cimock et al.
6,036,576 A * 3/2000 Colon, Jr. ..... 446/473

* cited by examiner

*Primary Examiner*—Derris H. Banks
*Assistant Examiner*—Faye Francis
(74) *Attorney, Agent, or Firm*—Christie, Parker & Hale, LLP

(57) ABSTRACT

A toy sword having at least one visual or auditory indicator for signaling a user when the sword contacts a target is provided. In one preferred embodiment the auditory indicator is a balloon disposed within the body of the sword and positioned to burst via mechanical pressure when the tip of the sword is depressed.

3 Claims, 4 Drawing Sheets

TOY SWORD WITH CONTACT INDICATOR

FIELD OF THE INVENTION

The present invention is directed to a toy sword; and more particularly to a toy sword having at least one visual or auditory indicator for signaling contact with a target.

BACKGROUND OF THE INVENTION

Toy swords, formed, for example, from plastic material, have been commercially available to delight children in fictitious sword play for many years. For example, many toy swords include switches which trigger certain visual and acoustic effects produced by electronic circuitry housed within the handle of the sword. Alternatively some toy swords may be activated by waving or otherwise agitating the sword causing a motion actuated switch embedded in the sword to momentarily close. The motion actuated switch may operate to create an auditory or visual display in the blade during use.

Further, since the movie "STAR WARS" was released in 1977, the concept of a sword made of light has captivated the imagination of both children and adults. Thus, toys have been developed which attempt to mimic the light sword with a flashlight and a colored, translucent tube attached thereto. When the flashlight is turned on, the tube generates a subtle glow. Some of the tubes even generate sound when swung through the air.

Some examples in U.S. Pat. No. 5,279,513 to Connely, which discloses a toy sword which contains means to provide focused light. U.S. Pat. No. 4,231,077 to Joyce discloses a light toy comprised of a flashlight and tube with a reflective surface inside the cap. U.S. Pat. No. 5,245,099 to Rudell et al. discloses a contact-activated pressurized water release toy. The toy contains a quantity of pressurized water which is subsequently released during play. U.S. Pat. No. 4,208,701 to Schock discloses a transparent elongated toy which internally reflects light to create different visual effects. U.S. Pat. No. 4,904,222 to Gastgeb; U.S. Pat. No. 4,678,450 to Scolari; and U.S. Pat. No. 5,321,591 to Cimock each disclose different light sword toys.

While these units may be suitable for the particular purpose employed, or for general use, they do not include mechanisms wherein the visual effects are actuated by the natural thrusting and parrying motions of sword play.

SUMMARY OF THE INVENTION

The present invention is directed generally to a toy sword having at least one indicator for signaling that a target has been contacted.

In one embodiment, the sword has a resiliently slidable tip portion such that when the tip portion strikes a target the tip retracts and an indicator is triggered. In one such embodiment the sword tip is resiliently biased by a spring disposed within the body of the sword.

In another embodiment, the indicator is a balloon disposed within a handle portion of the sword, the balloon being subject to a piercing action when the tip of the sword is depressed. In one such embodiment the handle of the sword is detachable to allow the insertion of a balloon therein.

In still another embodiment, the indicator is a filament disposed within the tip portion of the sword such that when the tip portion is depressed the filament extends out of the body of the sword.

In yet another embodiment, the indicator is an electronic auditory or visual signal triggered by the completion of an electronic circuit when the tip is depressed.

BRIEF DESCRIPTION OF THE DRAWINGS

These and other features and advantages of the present invention will be better understood by reference to the following detailed description when considered in conjunction with the accompanying drawings wherein.

DETAILED DESCRIPTION OF THE INVENTION

The present invention is directed to a toy sword; and more particularly to a toy sword having at least one visual or auditory indicator for signaling a user when the sword contacts a target.

Figure 1:
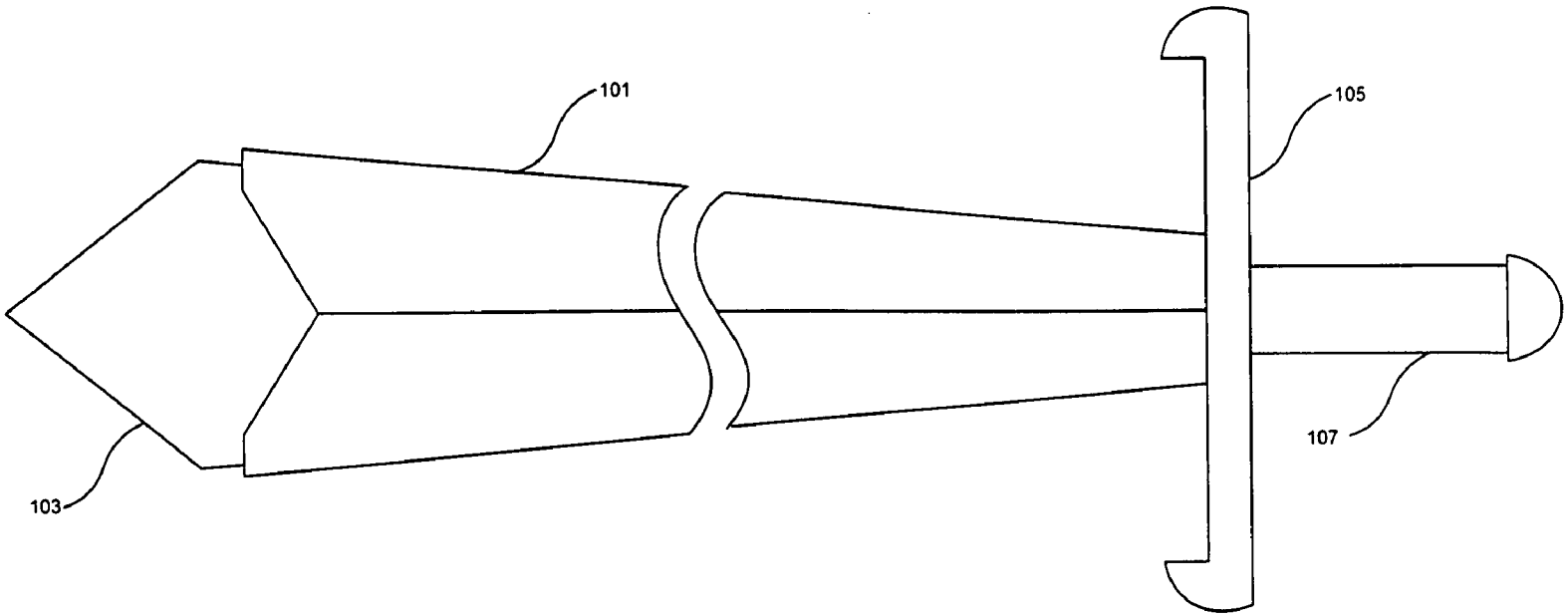
FIG. 1 shows a schematic view of a sword in accordance with one embodiment of the current invention.

The sword of the current invention generally comprises a hollow body 101 having a tip 103 resiliently biased and slidably disposed at its distal end and a handle 107 at its proximal end. One exemplary embodiment of the sword of the current invention is shown in FIG. 1. Although the embodiment depicted in FIG. 1 features a traditional sword design including a hilt type handle 107 having a handle guard 105, and tapered blade body 101, any sword design having a resiliently slidable tip and a generally hollow body may be used with the indicator features described herein.

Figure 2:
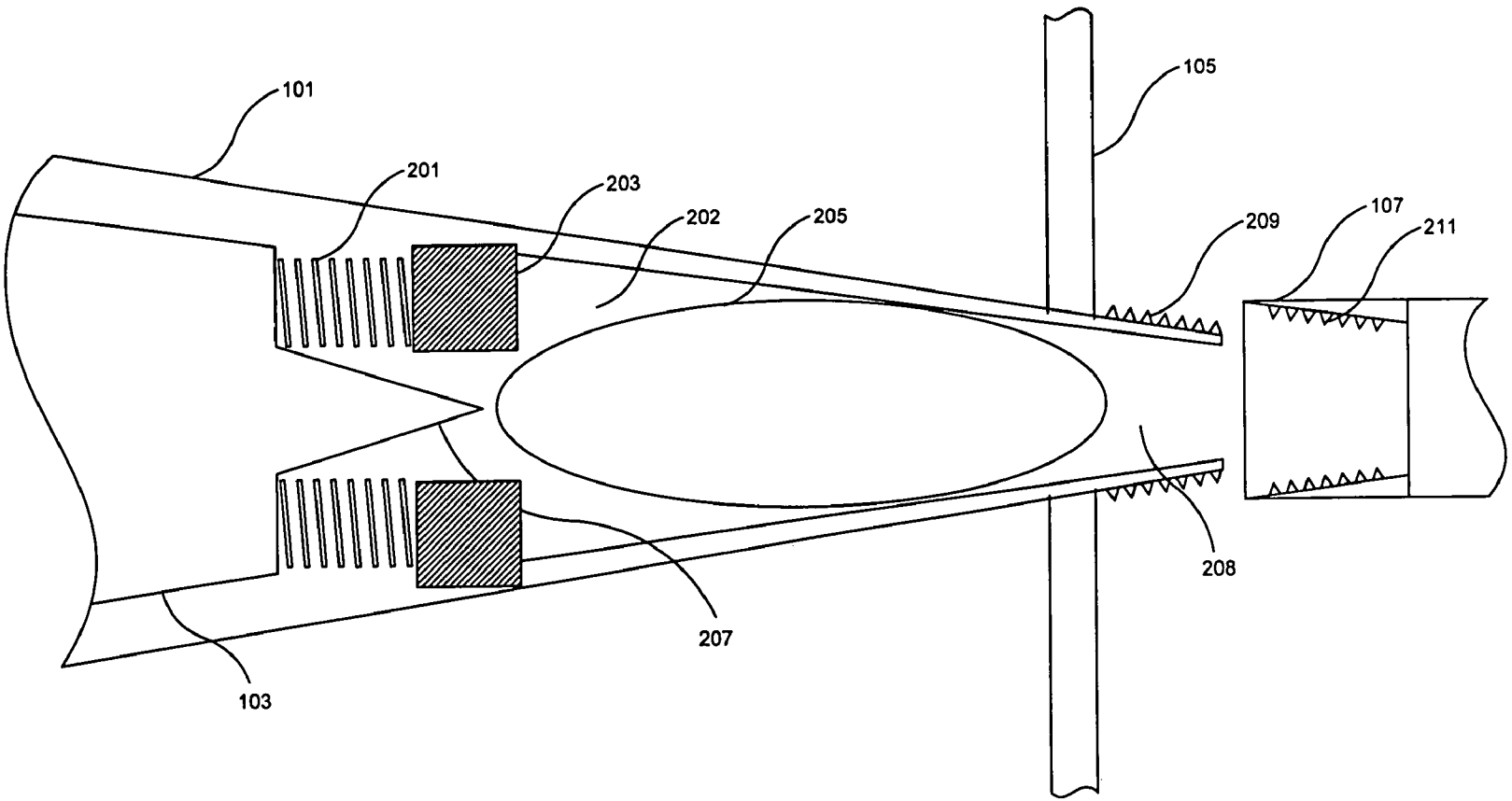
FIG. 2 shows a cross-sectional view of the handle portion of a sword in accordance with one embodiment of the current invention.

One exemplary embodiment of a mechanical auditory indicator in accordance with the current invention is shown schematically in FIG. 2. As shown, in this embodiment the indicator comprises a balloon 205 disposed within the generally hollow blade body 101 of the sword, and a sharp projection 207 formed at the proximal end of a slidable sword tip 103 that is resiliently biased, such as, for example, via springs 201 away from the balloon, but which can be brought into contact with the balloon to burst the balloon. In such an embodiment an opening 208 is provided in the sword to allow for the insertion and removal of balloons from within the body of the sword.

Specifically, in the embodiment shown in FIG. 2 the handle 107 of the sword and the proximal end of the sword body 101 are correspondingly threaded 211 and 209 such that the handle is rotatably attached to the sword body, and such that the handle may be remove to provide an opening 208 through which a balloon 205 may be inserted into the sword body. Although a threaded mechanism is shown in FIG. 2 it should be understood that any suitable mechanism may be used to removably attach the handle 107 onto the sword body 101, such as, for example, a friction fitting, a snap-lock fitting, etc. Further, although the embodiment shown in FIG. 2 depicts access to the interior of the sword body through the handle of the sword, other entry points could be provided anywhere along the sword body, such as, for example, an access hatch disposed on the sword body itself.

During operation, a balloon 205 is placed within the sword body 101 through the handle 107, and the handle closed to ensure that the balloon is securely held in place. Initially the tip of the sword 103, upon which the projection 207 is disposed, is biased distally away from the balloon 205 via springs 201. Once the tip 103 is depressed with sufficient force to overcome the resilient force of the springs, such as when the sword is thrust against a target, the springs 201 contract bringing the sharp projection 207 in contact with the balloon 205. The soft skin of the balloon is burst creating a loud bang. As shown in FIG. 2, stops 203 may be provided against which the springs 201 may rest to ensure that the tip 103 is not depressed too far within the body 101.

Although a spring 201 biased tip 103 is shown in FIG. 2, it should be understood that any mechanism for resiliently biasing the tip 103 of the sword and in turn the sharp projection 207 away from the balloon may be used, such as, for example, rubber bands or other resilient materials. Further, although the proximal end of the sword tip is used to burst the balloon in the embodiment shown in FIG. 2, it should be understood that any suitable balloon bursting mechanism may be used with the current invention such that thrusting, stabbing, or slashing the sword against a target creates sufficient pressure within the sword body to burst the balloon.

Although a mechanical auditory indicator mechanism is described above, other contact indicators may be incorporated, either alone or in combination into the sword of the current invention. For example, in another exemplary embodiment of the invention a visual indicator is provided in the tip of the sword to simulate blood when contact is made with a target.

Figure 3:
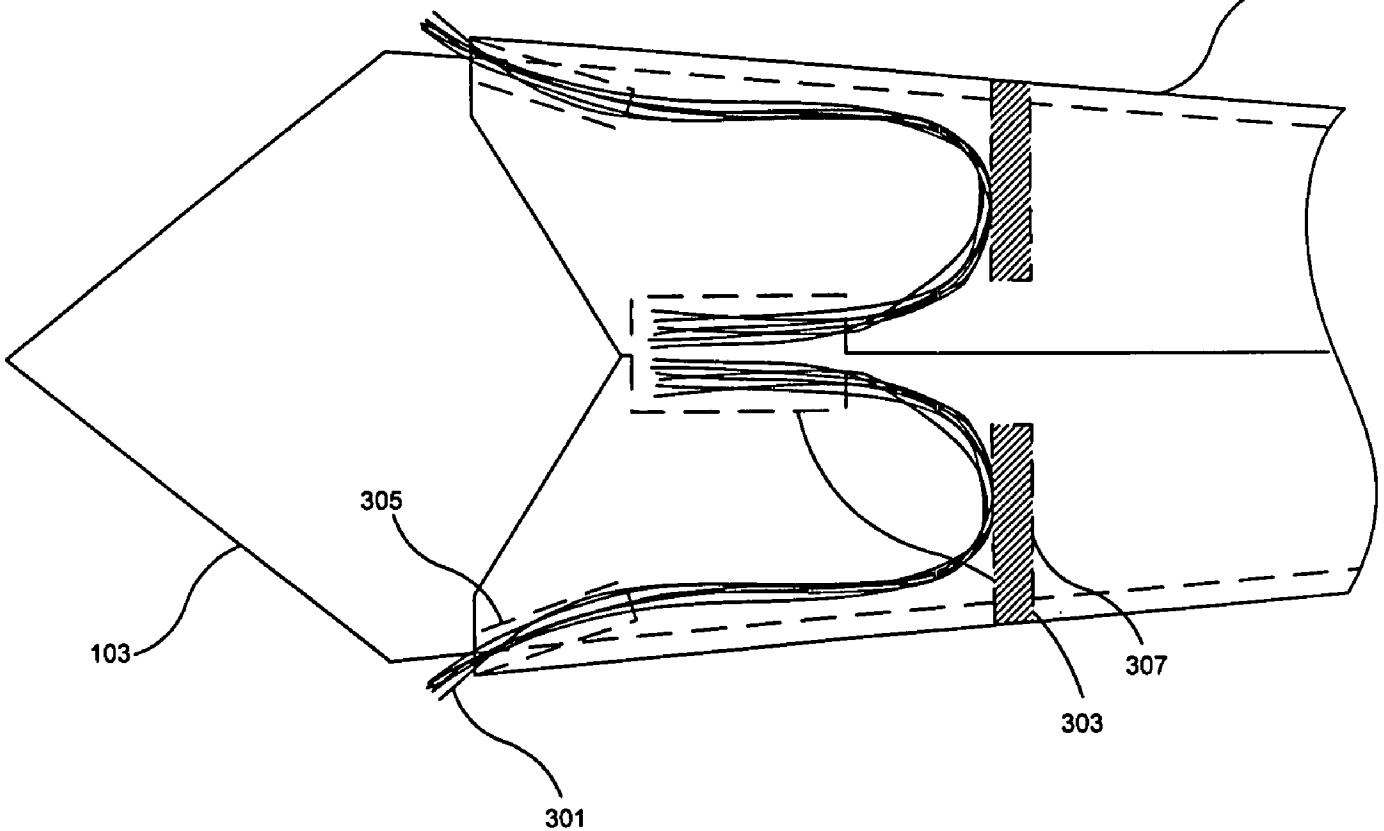
FIG. 3 shows a cross-sectional view of the tip portion of a sword in accordance with one embodiment of the current invention.

As shown in FIG. 3, in one exemplary embodiment the visual indicator comprises at least two colored filaments 301 having proximal and distal ends. The proximal ends of the filaments 301 are fixedly attached 303 to the proximal end of the slidably retractable sword tip 103, and the filaments are bent such that the distal end of the filaments may extend through the openings 305 at the distal end of the sword body 101 adjacent to the sword tip 103. As shown, a barrier 307 is provided at the bend of the filaments 301 such that when the tip of the sword 103 is depressed, such as when a target is contacted, the filaments are urged proximally back against a barrier 307 and redirected distally to extend through the openings 305 and out of the sword body 101 to visually indicate contact with the target.

Although one mechanism for extending the filaments is shown in FIG. 3, it should be understood that any suitable mechanism for extending filaments from the distal end of the sword when the tip of the sword is depressed may be utilized with the current invention. For example, the filaments could be spring loaded such that depressing the tip released the spring extending the filaments. It should also be understood that any type, number, and color of filament may be used with the current invention. Likewise, any means may be used to affix the filaments to the sword tip, such as, for example, mechanical fasteners, glues, tapes, etc.

Although mechanical indicator mechanisms are discussed above, electronic indicators may also be incorporated into the toy sword of the current invention. For example, in the exemplary embodiment shown in FIG. 4, an electronic auditory indicator is disposed within the body of the sword. As shown, the auditory electronic indicator of the embodiment generally comprises a speaker 407 in signal communication with a power supply 408 and eletronic circuitry 403, such as, for example a microprocessor. The components being disposed within the body 101 of the sword adjacent to the proximal end of the slidably retractable tip 103. In such an embodiment the proximal end of the tip is provided with an electrical contact 401 that when contacted with the circuitry 403 of the indicator completes the circuit and activates the electronic indicator, such as the speaker 407.

Figure 4:
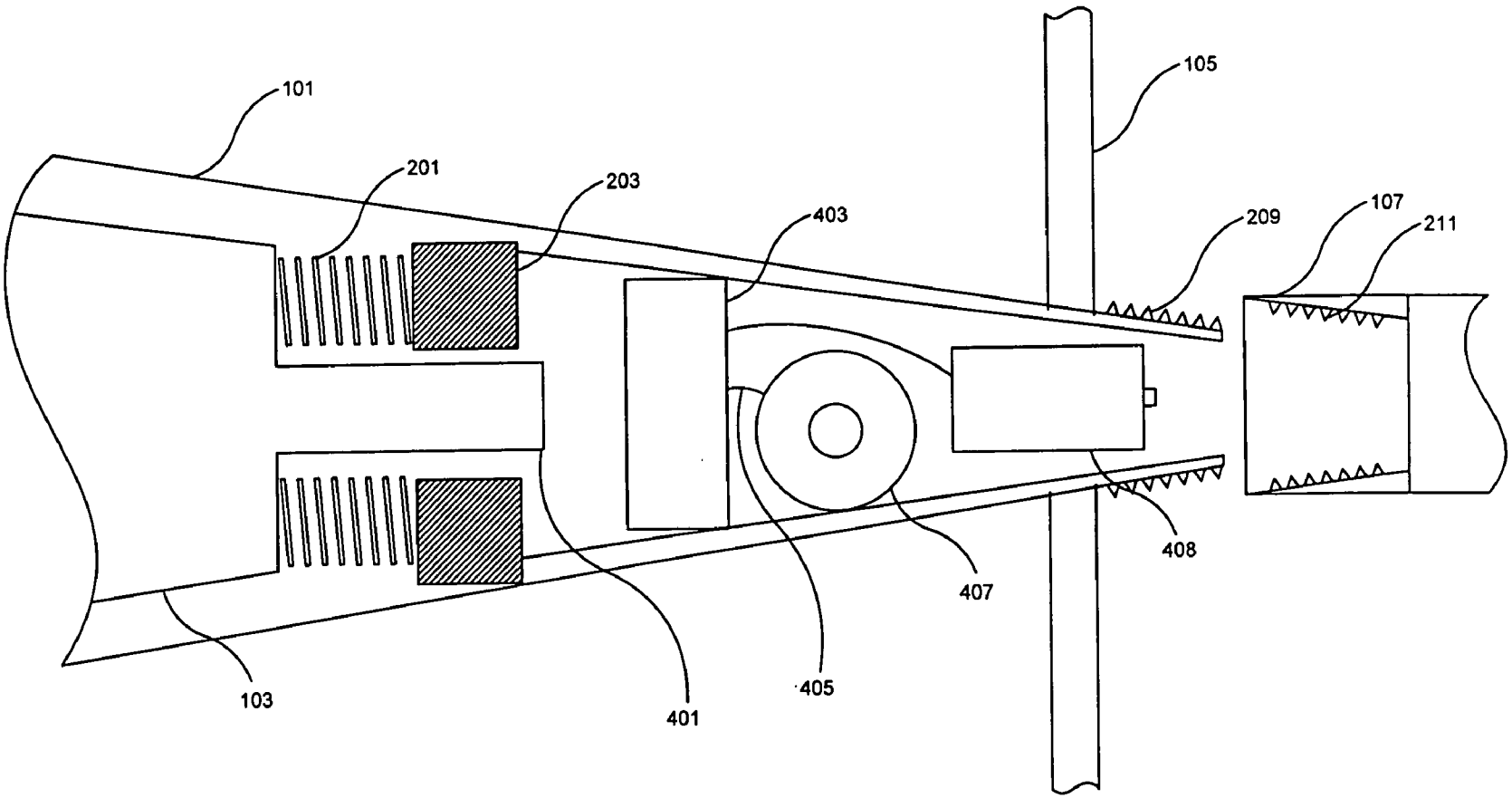
FIG. 4 shows a cross-sectional view of the handle portion of a sword in accordance with an alternative embodiment of the current invention.

Although a speaker is shown in FIG. 4, it should be understood that any suitable electronic indicator may be used in the current invention, such as, for example, lights disposed externally or internally, electronic vibrator, etc. In addition, although a general box for an electronic circuit 403 is provided, it should be understood that the circuit may comprise any suitable electronic element of programmable processor. Likewise, although a simple contact connection is shown in the FIG. 4, it should be understood that any device for triggering the circuit may be used, such as, for example a switch. Finally, although any power supply may be used, in one embodiment a battery power pack is provided. In such an embodiment an opening 208 is provided in the sword to allow for the insertion and removal of batteries from within the body of the sword.

Specifically, as discussed above with regard to FIG. 2 the handle 107 of the sword and the proximal end of the sword body 101 may be correspondingly threaded 211 and 209 such that the handle is rotatably attached to the sword body, and such that the handle may be remove to provide the opening 208 through which a battery 408 may be inserted into the sword body. Although a threaded mechanism is shown in FIG. 4 it should be understood that any suitable mechanism may be used to removably attach the handle 107 onto the sword body 101, such as, for example, a pressure fitting, a snap-lock fitting, etc. Further although the embodiment shown in FIG. 4 shows access to the interior of the sword body through the handle of the sword other entry points could be provided anywhere along the sword body, such as, for example, an access hatch disposed on the sword body itself.

During operation, the tip of the sword 103, upon which the contact 401 is disposed, is biased distally away from the circuitry 403 via springs 201. Once the tip 103 is depressed with sufficient force to overcome the resilient bias of the springs, such as when the sword is thrust against a target, the springs 201 contract bringing the contact 401 in signal communication with the circuitry 403. The completion of circuit in turn activates the electronic indicator 407. As discussed above, stops 203 may be provided against which the springs 201 rest to ensure that the tip 103 is not depressed too far within the body 101.

While this invention has been described in detail with reference to a certain preferred embodiments, it should be appreciated that the present invention is not limited to those precise embodiments. Rather, in view of the present disclosure that describes the current best mode for practicing the invention, many modifications and variations would present themselves to those of skill in the art without departing from the scope and spirit of this invention. In particular, it is to be understood that this invention is not limited to a single or particular combination of contact indicators, contact indicators and their equivalents could be combined in any number of ways, as will be appreciated by one of skill in the art. The scope of the invention is, therefore, indicated by the following claims rather than by the foregoing description. All changes, modifications, and variations coming within the meaning and range of equivalency of the claims are to be considered within their scope.

Unless defined otherwise, all technical and scientific terms used herein have the same meaning as commonly understood to one of ordinary skill in the art to which this invention belongs. Although any methods, devices and materials similar or equivalent to those described herein can be used in the practice or testing of the invention, the preferred methods, devices and materials are now described.

All publications mentioned herein are incorporated herein by reference for the purpose of describing and disclosing, for example, the compositions and methodologies that are described in the publications, which might be used in connection with the presently described invention. The publications listed or discussed above, below and throughout the text are provided solely for their disclosure prior to the filing date of the present application. Nothing herein is to be construed as an admission that the inventors are not entitled to antedate such disclosure by virtue of prior invention.

What is claimed is:

1. A toy sword having at least one perceivable contact indicator comprising:

a sword body defining an inner volume and having proximal and distal ends;

a sword tip having proximal and distal ends slidably disposed within the distal end of the sword body and resiliently biased in a distal direction;

a balloon disposed within the inner volume of the sword body adjacent to the proximal end of the sword tip such that when the sword tip is depressed in a proximal direction the balloon is subject to a bursting pressure; and a sword handle disposed on the proximal end of the sword body wherein the sword handle is removable to allow for the insertion of the balloon within the sword body.

2. The toy sword of claim 1, wherein the sword tip is resiliently biased via a spring.

3. The toy sword of claim 1, wherein the proximal end of the sword tip comprises a sharp projection such that when the sword tip is depressed in a proximal direction the sharp projection contacts the balloon.

* * * * *